US009044913B2

(12) United States Patent
Kurz et al.

(10) Patent No.: US 9,044,913 B2
(45) Date of Patent: Jun. 2, 2015

(54) MACHINE PRESS

(75) Inventors: Manfred Kurz, Altenstadt (DE); Bernhard Russ, Peiting (DE); Martin Rauwolf, Schongau (DE)

(73) Assignee: Hoerbiger Automatierungstechnik Holding GmbH, Altenstadt (DE)

( * ) Notice: Subject to any disclaimer, the term of this patent is extended or adjusted under 35 U.S.C. 154(b) by 433 days.

(21) Appl. No.: 13/467,474

(22) Filed: May 9, 2012

(65) Prior Publication Data

US 2012/0272840 A1 Nov. 1, 2012

Related U.S. Application Data

(63) Continuation of application No. PCT/EP2010/006842, filed on Nov. 10, 2010.

(51) Int. Cl.
*B30B 1/32* (2006.01)
*B30B 15/16* (2006.01)

(52) U.S. Cl.
CPC ..... *B30B 15/161* (2013.01); *B30B 15/163* (2013.01)

(58) Field of Classification Search
CPC ..... B21D 5/02; B30B 15/161; B30B 1/32; B30B 1/323; B21J 9/12; B21J 9/20
USPC ..... 100/43, 48, 269.01, 269.03, 269.05, 100/269.14, 269.18; 72/453.02, 453.06, 72/453.07, 453.08, 453.18, 16.9, 20.1, 72/21.4
See application file for complete search history.

(56) References Cited

U.S. PATENT DOCUMENTS

| | | | | |
|---|---|---|---|---|
| 3,691,946 | A * | 9/1972 | Ando | 100/269.05 |
| 5,568,766 | A * | 10/1996 | Otremba et al. | 100/35 |
| 6,145,307 | A * | 11/2000 | Dantlgraber | 60/327 |
| 6,240,758 | B1 * | 6/2001 | Nagakura | 72/20.1 |
| 2002/0062676 | A1 | 5/2002 | Yashima et al. | |
| 2003/0084794 | A1 * | 5/2003 | Koyama | 100/269.01 |
| 2010/0212521 | A1 | 8/2010 | Resch et al. | |

FOREIGN PATENT DOCUMENTS

| | | | | |
|---|---|---|---|---|
| AT | 008633 | U1 * | 10/2006 | B30B 1/32 |
| DE | 9207905 | U1 * | 8/1992 | B30B 15/16 |
| EP | 0 103 727 | | 3/1984 | |

(Continued)

OTHER PUBLICATIONS

International Search Report (with English Translation) for Corresponding International Application No. PCT/EP2010/0066842 mailed on Jun. 1, 2011.

*Primary Examiner* — Jimmy T Nguyen
(74) *Attorney, Agent, or Firm* — Myers Wolin, LLC

(57) ABSTRACT

In a machine press having a lower and an upper tool carrier, a hydraulic drive acting on the upper tool carrier comprises at least one closed hydraulic drive system that can be switched between rapid motion and press motion, the drive system having at least one hydraulic cylinder piston unit. The hydraulic liquid of the at least one hydraulic drive system is stored in a pressure accumulator fanning the storage container, supplying the entire associated hydraulic drive system. permanently with at least a base pressure above the ambient pressure. There is no hydraulic connection whatsoever between the working chamber on the piston rod side and the working chamber on the piston side of at least one hydraulic cylinder piston unit. The upper tool carrier is pre-stressed into its upper position by a spring unit.

13 Claims, 7 Drawing Sheets

(56) References Cited

FOREIGN PATENT DOCUMENTS

| | | |
|---|---|---|
| EP | 0 692 327 | 1/1996 |
| EP | 1 228 822 | 8/2002 |
| EP | 1 564 414 | 8/2005 |
| EP | 2 036 711 | 3/2009 |
| GB | 2 006 654 | 5/1979 |
| JP | 56165520 | 12/1981 |
| JP | 05015928 | 1/1993 |
| JP | 05293548 | 11/1993 |
| JP | 2000343126 | 12/2000 |
| JP | 2001113317 | 4/2001 |
| WO | 2004/101263 | 11/2004 |
| WO | 2005/121564 | 12/2005 |

* cited by examiner

MACHINE PRESS

CROSS REFERENCE TO RELATED APPLICATIONS

This application is a continuation of International Application No. PCT/EP2010/006842 filed on Nov. 10, 2010, which claims priority to German Patent Application No. 10 2009 052 531.9 filed on Nov. 11, 2009, the contents of each of which are incorporated herein by reference.

FIELD OF THE INVENTION

The present invention relates to a machine press with a machine structure, with a lower tool carrier disposed in fixed spatial relationship to the machine structure, with an upper tool carrier, which can be moved linearly up and down by an operating stroke relative to the lower tool carrier, and with a hydraulic drive acting on the upper tool carrier and causing the downwardly directed movement of the upper tool carrier.

BACKGROUND

Machine presses of the type mentioned in the foregoing are known in various embodiments. A typical example of such machine presses are folding presses, such as used for bending sheet metal. In this respect, JP 05293548 A, JP 56165520 A, JP 05015928 A, JP 2000343126 A, JP 2001113317 A, AT 008633 U1, EP 692327 B1, EP 1564414 A1, EP 103727 A1, DE 1906317, EP 1228822 B1 and EP 2036711 A1 in particular belong to the relevant prior art. In fact, a machine press is known from AT 008633 U1.

In practice, various requirements are imposed on folding presses and other machine presses of the type mentioned in the introduction. Thus the corresponding machines are supposed to work in a way that is reliable, inexpensive, economical, space-saving, maintenance- and user-friendly as well as long-lived and process-efficient, or in other words rapid, and also with the highest precision and reproducibility. Added to these are aspects such as workplace safety and energy efficiency as well as other ecological viewpoints, such as the use of environmentally compatible working resources.

SUMMARY

The object of the present invention is to provide a machine press that within the meaning of the catalog of requirements specified in the foregoing is characterized by particular practical utility, wherein special importance is placed on high reliability, maintenance and user friendliness as well as processing speed, or in other words short process cycles.

This object is achieved by a machine press of the type mentioned in the introduction that is further characterized by the following features in functional combination with one another:

- The hydraulic drive comprises at least one closed, independent hydraulic drive system, which in turn comprises at least one hydraulic cylinder-piston unit and at least one hydraulic assembly pressurizing it and supplied from a storage container.
- The at least one hydraulic drive system can be changed over between rapid motion, in which a first effective piston area is pressurized by the at least one hydraulic assembly, and press motion, in which the at least one hydraulic assembly pressurizes a second effective piston area that is substantially larger than the first effective piston area.

- The hydraulic fluid of the at least one hydraulic drive system is stored in a pressure accumulator, which constitutes the storage container and constantly imposes at least a base pressure higher than the ambient pressure on the entire hydraulic drive system in question.
- No hydraulic communication of any kind exists between the working chamber on the piston-rod side and the working chamber on the piston side of at least one hydraulic cylinder-piston unit of the at least one hydraulic drive system.
- The upper tool carrier is forced into its upper end position by means of a spring device, which overcompensates the weight (the weight force) of the upper tool carrier, of the tool mounted thereon and of the components of the hydraulic drive associated with the upper tool carrier as well as the closing force implied by the base pressure prevailing in the at least one hydraulic drive system.

A particularly pronounced advantage distinguishing the inventive machine press from the prior art consists in the achievable very fast working speed, or in other words the minimum cycle times. This is achieved by a substantial shortening of the dead or idle times that is possible during application of the invention, or in other words those times during which the upper tool carrier of the machine press performs inefficient idle strokes. In this respect, the present invention exploits the circumstance among others that typically only a small fraction (such as 3 mm) of the entire operating stroke (such as 40-50 mm) of conventional folding and other machine presses constitutes the press motion causing deformation of the workpiece, while a much larger fraction of the operating stroke represents an inefficient idle stroke. Certainly it is known, as is also implemented in the inventive machine press, that the at least one hydraulic drive system of the hydraulic drive can be designed such that the idle stroke can be operated in so-called rapid motion with relatively high speed; nevertheless, as has now been recognized by the inventors of the present invention, a not inconsiderable potential for shortening the cycle time still remains, even without impairing or restricting the achievement of the remaining practically relevant requirements; to the contrary, diverse other requirements can also be met even more extensively by inventive machine presses than according to the prior art, as will be explained in detail hereinafter.

In the functional interaction with the further features characterizing the inventive machine press, it is of special importance that the at least one hydraulic drive system be provided with a storage container for the hydraulic fluid, constructed as a pressure accumulator and prepressurized such that a base pressure higher than the ambient pressure (standard conditions according to DIN) prevails constantly, or in other words at every position and at every time during the entire operating cycle, in the entire hydraulic drive system in question. Its purpose is to ensure particularly rapid, complete and smooth filling of the at least one hydraulic cylinder-piston unit of the at least one hydraulic drive system during rapid motion, wherein, to achieve the high speed of the upper tool carrier, only part of the total available piston area, namely only the first effective piston area, is pressurized by the hydraulic assembly, while the working chamber bounded by the remaining portion of the entire piston area is (directly) supplied (filled) from the storage container. In this way, the working chamber of the at least one hydraulic cylinder-piston unit not pressurized by the hydraulic assembly is actively filled from the pressure accumulator during rapid motion. This in turn permits not only an increase of movement speed in rapid motion but also the use of relatively compact, so-called "prefill valves", or in other words prefill valves with relatively small flow cross sections, wherein the danger of cavitation in the hydraulic fluid does not exist. For its part, by virtue of correspondingly small masses, the correspondingly compact dimensioning of the prefill valves, which typically can be changed over between a prefill and working position secured by a check valve and a wide-open position appropriate for retraction of the hydraulic drive (upward movement of the upper tool holder) acts positively on the operating dynamics of the valve, in turn benefiting the machine dynamics. In this respect it proves favorable, again in the functional interaction with the technical viewpoints explained in the foregoing, that the upper tool carrier is forced in the direction of opening of the machine press, or in other words into its upper end position, by means of a (constantly acting) spring device, which overcompensates the weight (the weight force) of the upper tool carrier, of the tool mounted thereon and of the components of the hydraulic drive associated with the upper tool carrier as well as the closing force implied by the base pressure prevailing in the at least one hydraulic system. By this means, opening of the machine press begins immediately upon ending of the pressurization of the second effective piston area of the at least one hydraulic cylinder-piston unit of the at least one hydraulic drive system by the hydraulic assembly, wherein the shortest travel and thus the smallest masses to be accelerated can in turn be achieved advantageously (see hereinafter).

As regards the class-defining AT 008633 U1, it is completely surprising in this connection that the desired advantages can be achieved by the inventive configuration of the hydraulic drive. After all, the circumstance that a force (closing force) acting on the (respective) piston is constantly generated due to the constant pressurization of the entire hydraulic drive system (or of the entire hydraulic drive systems) by a (respective) pressure accumulator with a pressure level in the drive system (or in the drive systems) higher than the ambient pressure necessitates a spring device having correspondingly larger or heavier dimensions and at first sight suggests that the machine dynamics would suffer therefrom, that during raising of the upper tool carrier the spring device would have to overcome or compensate for not only the weight of the parts being moved but also the said constantly acting force. In this respect the inventive configuration of the machine press is also not anticipated at all by AT 008633 U1.

In typical cases of application, the advantageous effects of the present invention explained hereinabove already become apparent at a base pressure only moderately exceeding the ambient pressure, for example already when the base pressure, which prevails constantly, or in other words at every location and at every time during the entire operating cycle in the hydraulic drive system in question, is approximately 1 bar higher than the ambient pressure. In such a design of the hydraulic drive system, the pressure accumulator is designed such that it still continues to impose a gauge pressure of approximately 1 bar above the ambient pressure on the hydraulic system at minimum filling, or in other words when the piston of the associated cylinder-piston unit is completely lowered. A preferred base pressure is approximately 1 to 2 bar above the ambient pressure. Preferably this design of the pressure accumulator and its adaptation to the further components of the hydraulic drive system is configured such that the maximum pressure established in the pressure accumulator when the piston of the cylinder-piston unit is completely raised and thus the pressure accumulator is filled to the maximum does not exceed approximately 5 bar, particularly preferably between approximately 4 and 5 bar.

A first preferred improvement of the invention is characterized in that the hydraulic drive comprises two hydraulic drive systems with respectively at least one cylinder-piston unit, wherein each of the two hydraulic drive systems comprises its own hydraulic assembly. In this way it is not only possible to achieve the shortest line lengths within the hydraulic drive, which in turn—by virtue of the reduced masses to be moved and smaller line losses—is favorable both for high-performance machine dynamics and for high efficiency. From viewpoints of ease of assembly, maintenance and service also, this construction offers considerable advantages, as will become apparent from the further explanations of the present invention.

According to another preferred improvement of the present invention, the spring unit is integrated into at least one hydraulic cylinder-piston unit of the at least one hydraulic drive system. Particularly preferably it is constructed as a gas spring. In this respect, namely the piston-rod working chamber (filled with hydraulic fluid) of the hydraulic cylinder-piston unit in question can be placed in hydraulic communication with an external correspondingly prepressurized pressure accumulator —this has nothing to do with the pressure accumulator explained in the foregoing in the hydraulic drive system. The pressure accumulator used solely for opening of the machine press, and in terms of the pressure conditions, volumes and other constructive features matched specifically to the requirements existing in this respect, can be mounted directly on the cylinder of the hydraulic cylinder-piston unit in question, which in turn not only makes it superfluous to lay separate hydraulic lines but also—in the sense of optimum efficiency—minimizes the masses to be moved and the line losses.

It is even more favorable when the piston-rod working chamber of the hydraulic cylinder-piston unit in question is itself filled with a spring gas, which becomes compressed during the downward movement of the upper tool carrier. Compared with the configuration explained in the foregoing, this reduces the masses being moved even more, because no hydraulic fluid has to be pushed in the piston-rod working chamber, between this and the (external) pressure accumulator or in the latter, thus contributing to the possibility of a further improvement of the machine dynamics. In this case the (gas-filled) piston-rod working chamber can be placed in communicating relationship with internal gas-filled equalization chambers, which are provided inside the cylinder-piston unit and which in particular may be disposed in the piston and/or in the housing, in order to adapt the spring characteristic of the gas spring optimally to the respective application. Such internal equalization chambers make it possible in turn to configure particularly compact and more lightweight drive units with minimum moved masses, because the axial length of the piston-rod working chamber does not have to be appreciably larger than the stroke of the drive unit, merely to provide a residual space for receiving the gas filling at maximum compression. Otherwise, the fact of disposing the said compensating chamber in the piston at a suitable location may contribute to a further weight reduction.

In the context of balanced matching of the hydraulic drive as regards optimizing the conditions existing in rapid motion and in press motion, it is particularly advantageous when the area ratio between the second effective working area and the first effective working area is at least 3.

In yet another preferred improvement of the inventive machine press, there is provided a machine controller, which is acted on by a pressure sensor that determines the working pressure in the at least one hydraulic drive system. The fact that the specific pressure conditions actually existing in the hydraulic drive during the respective current individual task of the press are taken into consideration in the machine controller permits a purposeful individual influence to be exerted on the hydraulic drive, and, in fact, not merely for minimizing the duration of the respective working cycle but also as regards the quality of the results of workpiece forming. This is true in particular in the case in which the hydraulic drive of the inventive machine press has access to two or even more independent, self-contained hydraulic drive systems, which by means of control engineering can be matched to one another via balancing of the respective pressure conditions in the (common) machine controller. As an example, off-centered loading of a workpiece in the machine press can be compensated by control engineering.

Yet another preferred improvement of the inventive machine press is characterized in that, in the at least one hydraulic drive system, the at least one hydraulic cylinder-piston unit and the associated hydraulic assembly represent a complete drive with a common control, valve and line block, to which the associated pressure accumulator is also directly connected, so that no free pipe or hose lines exist. Hereby structural and functional relationships that are optimum in many respects can be achieved, namely as regards the necessary overall space, the achievable efficiency, the assembly time and effort, the reliability and the ease of maintenance and service. This accommodates the users' needs and interests most extensively, since in the case of such a hydraulic complete drive with a hydraulic system that is completely closed—because of the construction of the storage container for the hydraulic fluid as a pressure accumulator—the interfaces that exist to the machine controller must be exclusively electrical.

According to another preferred improvement of the invention, the hydraulic assembly is constructed as a reversing assembly, or in other words as an assembly with reversible delivery device. More details in this regard are specified hereinafter.

In special machine arrangements, it may prove advantageous when the at least one hydraulic drive system comprises two optionally connectable hydraulic pumps (which may be of different design). Specifically in this case the pressurization of the at least one hydraulic cylinder-piston unit in rapid motion and in press motion may be adapted individually, with a relatively broad spectrum, to the specific task of the press, especially by pressurizing the first effective piston area in rapid motion with two hydraulic pumps operated in parallel and pressurizing the second effective piston area in press motion with only one hydraulic pump.

Against a comparable background, it may be favorable in particular machine arrangements when the at least one hydraulic drive system comprises two optionally connectable hydraulic cylinder-piston units, of which one can be operated as a differential cylinder in rapid motion by placing the two working chambers in hydraulic communication with one another. Specifically in this case—in the interests of rapid movement of the upper tool carrier—only one of the hydraulic cylinder-piston units can be pressurized in rapid motion, whereas in press motion—in order to increase the press force—both hydraulic cylinder-piston units can be pressurized.

BRIEF DESCRIPTION OF THE FIGURES

The present invention will be explained in more detail hereinafter on the basis of preferred exemplary embodiments illustrated in the drawing, wherein.

DETAILED DESCRIPTION

Figure 1:
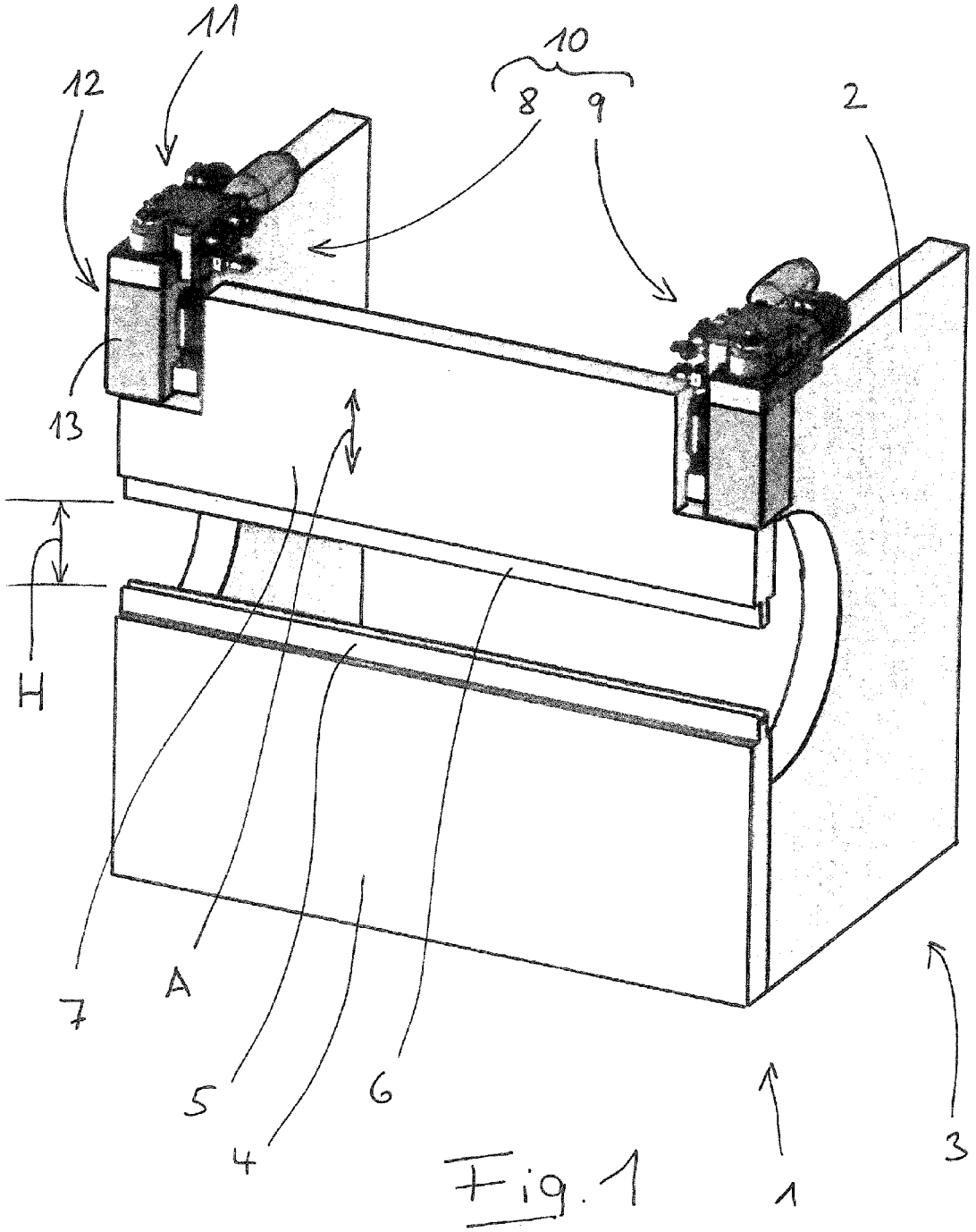
FIG. 1 shows a perspective, partly schematic view of an exemplary embodiment for an inventive machine press constructed as a folding press and provided with two hydraulic drive units.

Machine press 1 shown in FIG. 1 and constructed as a folding press is provided with a machine structure 3 comprising two C-frames 2. In fixed spatial relationship to machine structure 3, namely on each lower profile arm of the two C-frames 2, there is disposed thereon a lower tool carrier 4 with a lower bending tool 5. An upper tool carrier 7, equipped with an upper bending tool 6 and shown in its upper position in FIG. 1, can be moved linearly up and down (double arrow A) by an operating stroke H relative to lower tool carrier 4. Since the folding press shown in FIG. 1 corresponds in this scope to the sufficiently known prior art, further explanations in this respect are unnecessary. This is also true for constructive details known in themselves and not shown here, for example as regards the connection of the bending tools to the respective associated tool carrier.

In order to achieve the downwardly directed movement of the upper tool carrier, there are provided two hydraulic drive systems, namely a left hydraulic drive system 8 and a right hydraulic drive system 9, which together form a hydraulic drive 10 acting on upper tool carrier 7. The two hydraulic drive systems 8 and 9 are closed and independent, meaning that they have no kind of hydraulic communication with one another. They are constructed in the form of complete drives 11.

Figure 2:
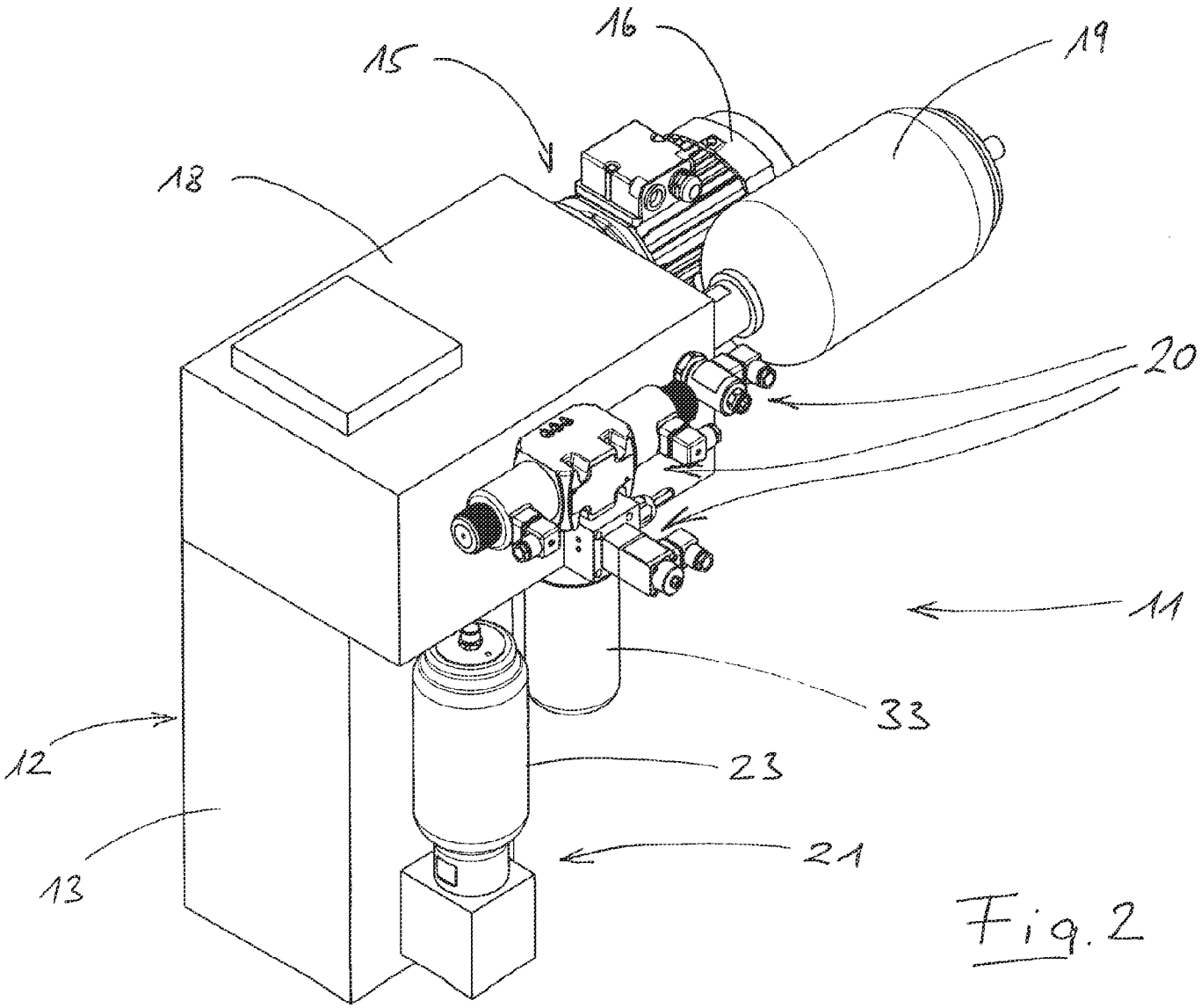
FIG. 2 shows a perspective view of a complete drive of the type used in the folding machine shown in FIG. 1.

Each of the two complete drives 11—constructed as mirror images—comprises in particular (see also the hydraulic diagram of connections according to FIG. 3) a hydraulic cylinder-piston unit 12 with a cylinder 13 and a piston 14 guided therein, the piston rod of which is firmly connected to upper tool carrier 7, and a hydraulic assembly 15 with a reversible hydraulic pump 17 driven by an electric motor 16 for pressurizing hydraulic cylinder-piston unit 12. Hydraulic pump 17 is mounted as a built-in pump in a common control, valve and line block 18, which therefore also forms a pump block at the same time and on which cylinder 13 and electric motor 16 are also directly flanged. Also flanged directly onto control, valve and line block 18 is a pressure accumulator 19, which forms a storage and equalization container for the hydraulic fluid of hydraulic drive system 8 and in particular supplies hydraulic assembly 15. The hydraulic system is hermetically sealed. Therein the hydraulic fluid is trapped, and a base pressure at least exceeding the ambient pressure prevails constantly and everywhere, as imposed thereon by pressure accumulator 19. By the fact that hydraulic cylinder-piston unit 12, pressure accumulator 19 and necessary valves 20, illustrated only schematically in FIGS. 1 and 2, as well as a filter 33 for the hydraulic oil are flanged directly onto control, valve and line block 18, and also that the hydraulic pump is mounted therein, no kind of free pipe or hose lines, which in other words would be laid outside control, valve and line block 18, exist that would place the said hydraulic components in communication with one another.

Upper tool carrier 7 is forced into its upper end position (FIG. 1) by means of a spring device 21, which overcompensates the weight of upper tool carrier 7, of tool 6 mounted thereon and of the components of hydraulic drive 10 associated with the upper tool carrier, or in other words piston 14 of the two hydraulic drive systems 8 and 9, as well as the closing force implied by the base pressure prevailing in the two hydraulic systems. The spring device is integrated into hydraulic-cylinder units 12 of the two hydraulic drive systems 8 and 9 in such a way that the respective piston-rod working chamber 22 of the hydraulic cylinder-piston unit 12 is in hydraulic communication with an associated external pressure accumulator 23. The external pressure accumulator 23 is flanged directly onto associated cylinder 13, so that again no kind of free pipe or hose lines exist that would place pressure accumulator 23 in communication with associated hydraulic cylinder-piston unit 12. By appropriate gas prepressurization in pressure accumulators 23, spring unit 21 is constructed as a gas spring. Since the upwardly directed movement of upper tool carrier 7 takes place solely due to spring device 21, or in other words by pressurization of piston-rod working chambers 22 by the respective associated pressure accumulator 23, the hydraulics of spring device 21 form a closed system, wherein hydraulic communication between working chamber 22 on the piston rod side and working chamber 24 on the piston side does not exist, especially in either of the two cylinder-piston units 12.

Hydraulic drive 10 of the folding press can be changed over between rapid motion and press motion. In this situation, once the upwardly directed force of spring device 21 is acting constantly in such a magnitude on upper tool carrier 7 that the weight of all movable components of the folding press as well as the closing force implied by the base force prevailing in the two hydraulic drive systems is overcompensated and the upper tool carrier is forced into its uppermost position, active movement of upper tool carrier 7 by hydraulic drive 10, but not free movement due to gravity, takes place even in rapid motion. This is achieved by the fact that an auxiliary piston 26 plunges into each of pistons 14 of the two hydraulic cylinder-piston units 12, namely into a respective bore 25 made therein. More details in this regard may be inferred from AT 8633 U1 (FIGS. 3 and 4 together with associated description). As a result, the hydraulic assembly pressurizes a relatively small first effective piston area 27 in rapid motion, but a substantially larger second effective piston area 48, composed of first effective piston area 27 of auxiliary working chamber 28 and annular area 29 of working chamber 24 on the piston side, in press motion. For changeover between rapid motion and press motion there is provided valve 30, which blocks the communication of hydraulic assembly 15 with piston working chamber 24 in rapid motion but opens it in press motion. In rapid motion, filling of piston working chamber 24 takes place via the path of prefill valve 32, which is secured by a check valve 31. Hydraulic aggregate 15 and hydraulic cylinder-piston unit 12, especially auxiliary piston 26 and first effective piston area 27 thereof, are matched to one another such that, in rapid motion—allowing for the weight force of the movable components of the folding press and the closing force established by the base pressure supplied via pressure accumulator 19 and prevailing in piston working chamber 24—the opposing force of spring device 21 can be overcome.

Figure 3:
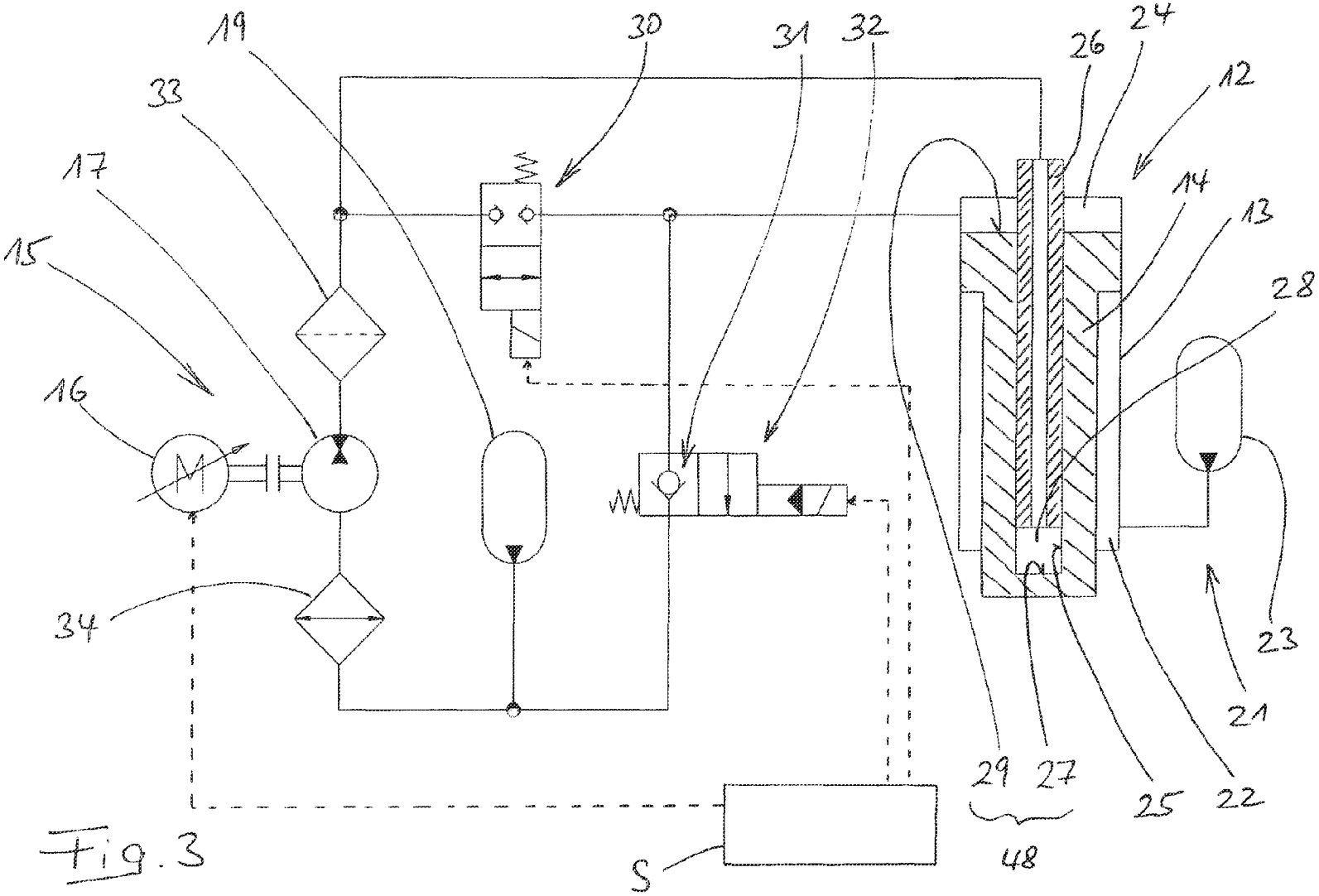
FIG. 3 shows a hydraulic diagram of connections of the drive units of the folding press shown in FIG. 1.

For the press motion, valve 30 is changed over, so that hydraulic assembly 15 pressurizes piston working chamber 24 and auxiliary working chamber 28 in parallel. At the end of the closing movement, or in other words typically when upper tool carrier 7 reaches a predetermined position, the delivery of hydraulic assembly 15 is reduced and stopped, so that the upper tool carrier is held in position. The tool then pauses for a short time, before the so-called "decompression stroke" sets in, or in other words the slow, controlled raising of the upper tool and opening of the press over a short stroke (such as 2-3 mm) due to reversal of the direction of delivery of the reversible hydraulic assembly. At the end of the decompression stroke, or in other words when the high pressure in the system has been at least substantially dissipated, valve 30 and prefill valve 32 are changed over, so that the base pressure imposed on the system by pressure accumulator 19 is established in piston working chamber 24 and piston 14 retracts under the action of spring device 21. The retraction of piston 14 takes place in controlled (braked) manner in rapid motion, by the fact that auxiliary working chamber 28 is emptied in controlled and directed manner into pressure accumulator 19 via hydraulic assembly 15, which is still being operated in reverse delivery direction opposing closing of the press. In this respect, as illustrated in FIG. 3, the delivery power of hydraulic assembly 15 is reversible and adjustable in this hydraulic drive system. Also illustrated are oil filter 33 and oil cooler 34. In connection with the fact that the storage capacity of pressure accumulator 19 is relatively small, this oil cooler is in any case much smaller than the conventionally used ventilated tank, and so only a reduced surface area is available for heat removal. Machine controller S communicates via appropriate control lines with motor 16 of hydraulic assembly 15 as well as with valve 30 and prefill valve 32, and, in fact, with the corresponding components of both hydraulic drive systems 8 and 9.

Figure 4:
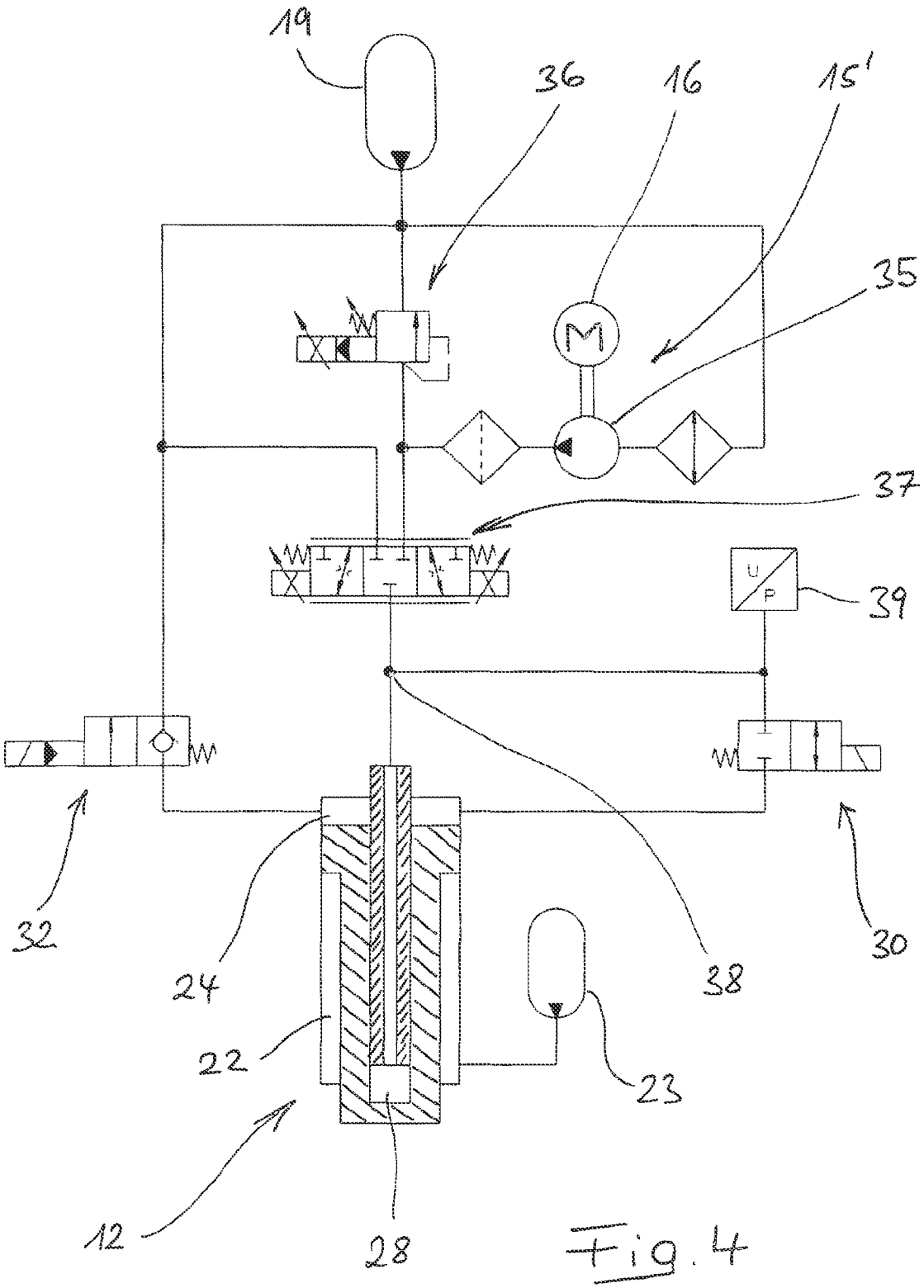
FIG. 4 shows a modification of the hydraulic diagram of connections according to FIG. 3.

The modified hydraulic system illustrated in FIG. 4 differs from that according to FIG. 3 mainly by a different construction of hydraulic assembly 15'. This namely comprises a constant pump 35, or in other words a continuously delivering pump. Accordingly, a pressure limiting valve 36, which diverts the delivery flow in excess of the demand existing at the respective operating point, is provided on the pressure side. Furthermore, a 3/3 directional valve 37 is disposed between hydraulic assembly 15' and hydraulic cylinder-piston unit 12. Besides the shown zero position, in which the three ports are blocked relative to one another, this can assume a Close position and an Open position. In the Close position—depending on the position of valve 30—either only auxiliary working chamber 28 (rapid motion) or else this and additionally also piston working chamber 24 (press motion) are pressurized by hydraulic assembly 15'. In the Open position, cylinder port 38 is in communication with pressure accumulator 19. In this case, the above descriptions are similarly applicable for the end of the press motion and the opening of the press. At the end of the closing movement, or in other words typically when upper tool carrier 7 reaches a predetermined position, directional valve 37 is changed over to its zero position (blocking position), and so the upper tool carrier is held in position. In order to initiate the "decompression stroke", directional valve 37 is changed over to its Open position, wherein pressure dissipation takes place both in piston working chamber 24 and in auxiliary working chamber 28, and the slow, directed raising of the upper tool and opening of the press take place in controlled manner via a drainage edge. At the end of the decompression stroke, valve 30 and prefill valve 32 are changed over, so that the base pressure imposed on the system by pressure accumulator 19 is established in piston working chamber 24 and piston 14 retracts under the action of spring device 21. The retraction of piston 14 takes place in controlled (braked) manner in rapid motion, by the fact that auxiliary working chamber 28 is emptied in controlled and directed manner into pressure accumulator 19 via directional valve 37, namely via the drainage edge thereof.

Also shown in FIG. 4 is a pressure sensor 39 that constantly records the working pressure prevailing in hydraulic cylinder-piston unit 12. The pressure signal is processed in machine controller S. In this case it may be used in particular in the sense of an auxiliary regulation variable, checked for its plausibility as the signal of the independently working displacement-measuring transducer and if necessary modified for further processing in the controller. The latter option comes into consideration in particular when the displacement-measuring signal (for example, in the case of a fixed component and/or excessive limiting friction) does not indicate any kind of movement, whereas the pressure signal indicates that the working pressure within the hydraulics is such that movement of the upper tool holder would actually be expected. Such abnormal operating states can be detected by taking the pressure signal into consideration or evaluating it, and an influence can be exerted on the machine controller, for example in order to prevent the upper tool carrier from suddenly breaking loose due to further pressure elevation and jeopardizing safety at the workplace. Also, if the pressure sensor reacts to changes within the hydraulic drive earlier than the displacement-measuring system, it is possible, by comparing the signals of the displacement-measuring system and of the pressure sensor, to optimize the controller in the sense of complying with a predetermined speed profile for the upper tool carrier as exactly as possible, which in turn may contribute to further shortening of the cycle time—especially by minimizing the transition times.

Figure 5:
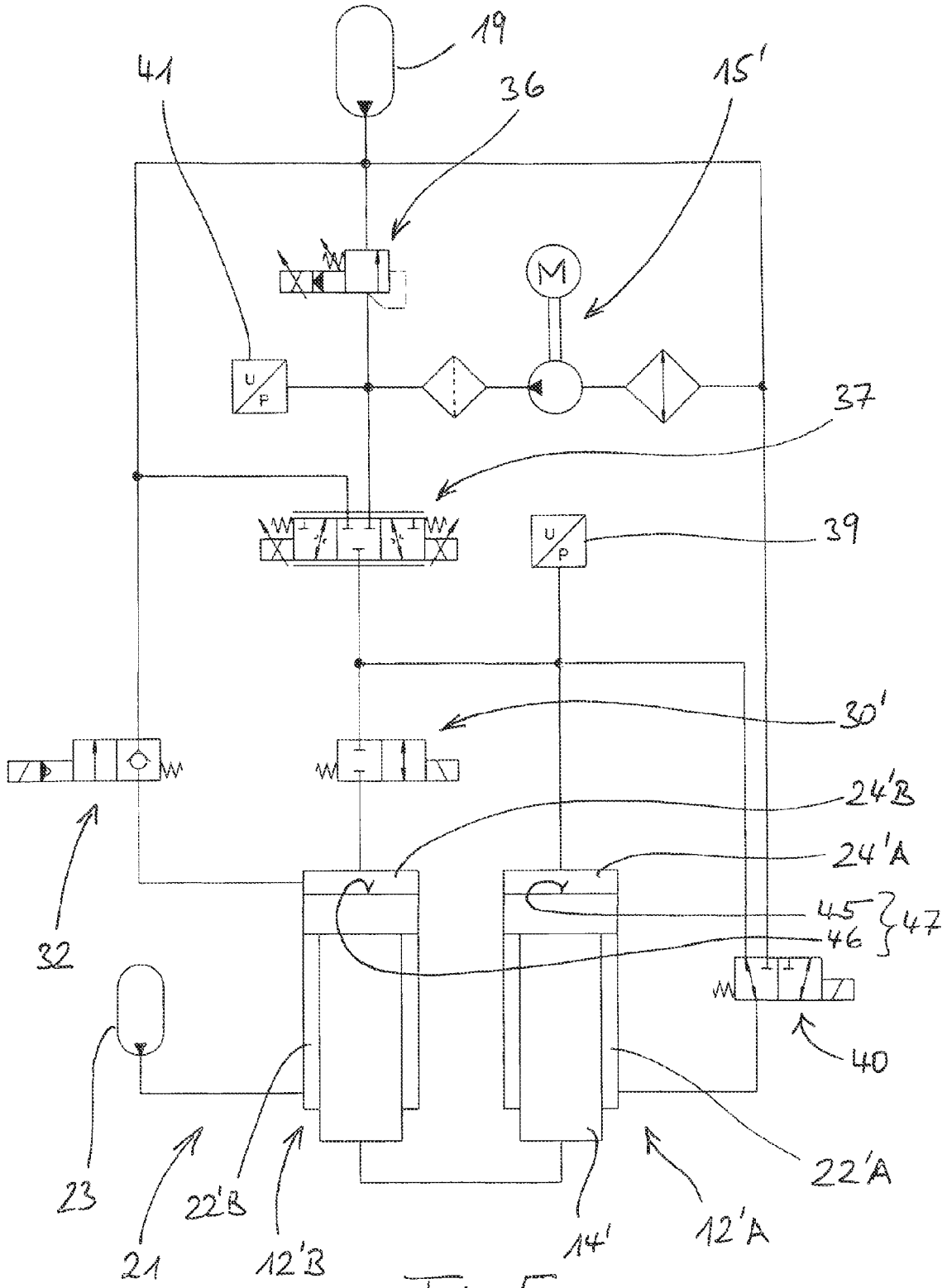
FIG. 5 shows the hydraulic diagram of connections of a modified drive unit and FIG. 6 shows a modification of the hydraulic diagram of connections according to FIG. 5; furthermore.

The hydraulic system according to the hydraulic diagram of connections illustrated in FIG. 5 differs from that according to FIG. 4 in particular by the fact that it has two structurally separated hydraulic cylinder-piston units 12'A and 12'B, the pistons 14' of which are nevertheless both joined to upper tool carrier 7 and in this way are coupled with one another. Of the two hydraulic cylinder-piston units 12'A and 12'B, it is optionally possible, by changeover via valve 30', to pressurize only one by hydraulic assembly 15', namely hydraulic cylinder-piston unit 12'A illustrated at the right in the drawing, or else both cylinder-piston units 12'A and 12'B simultaneously and in parallel. In rapid motion, only hydraulic cylinder-piston unit 12'A is pressurized, and so first effective piston area 45 is identical with the end-face area of piston 14'A. Piston working chamber 24'B of the other hydraulic cylinder-piston unit 12'B, which has no communication of any kind with the associated piston-rod working chamber 22'B, which in turn is pressurized solely by spring device 21, becomes filled via prefill valve 32. To avoid unnecessary hydraulic flows, piston working chamber 24'A and piston-rod working chamber 22'A of hydraulic cylinder-piston unit 12'A can be short-circuited via valve 40 during rapid motion; in this operating position of valve 40, hydraulic cylinder-piston unit 12'A acts as a differential cylinder. In press motion, when both hydraulic cylinder-piston units 12'A and 12'B are pressurized on the piston side by hydraulic assembly 15' via corresponding operation of valve 30, in which case the end-face area of piston 14'A and end-face area 46 of piston 14'B together form second effective piston area 47, piston-rod working chamber 22'A of hydraulic cylinder-piston unit 12'A is placed in communication with pressure accumulator 19 by changeover of valve 40, in order to supply the maximum closing force.

Also shown in FIG. 5 is a further pressure sensor 41, which constantly records the pump pressure prevailing on the pressure side of hydraulic assembly 15'. The pressure signal of this pressure sensor is also processed in a machine controller common to both hydraulic drive systems.

Figure 6:
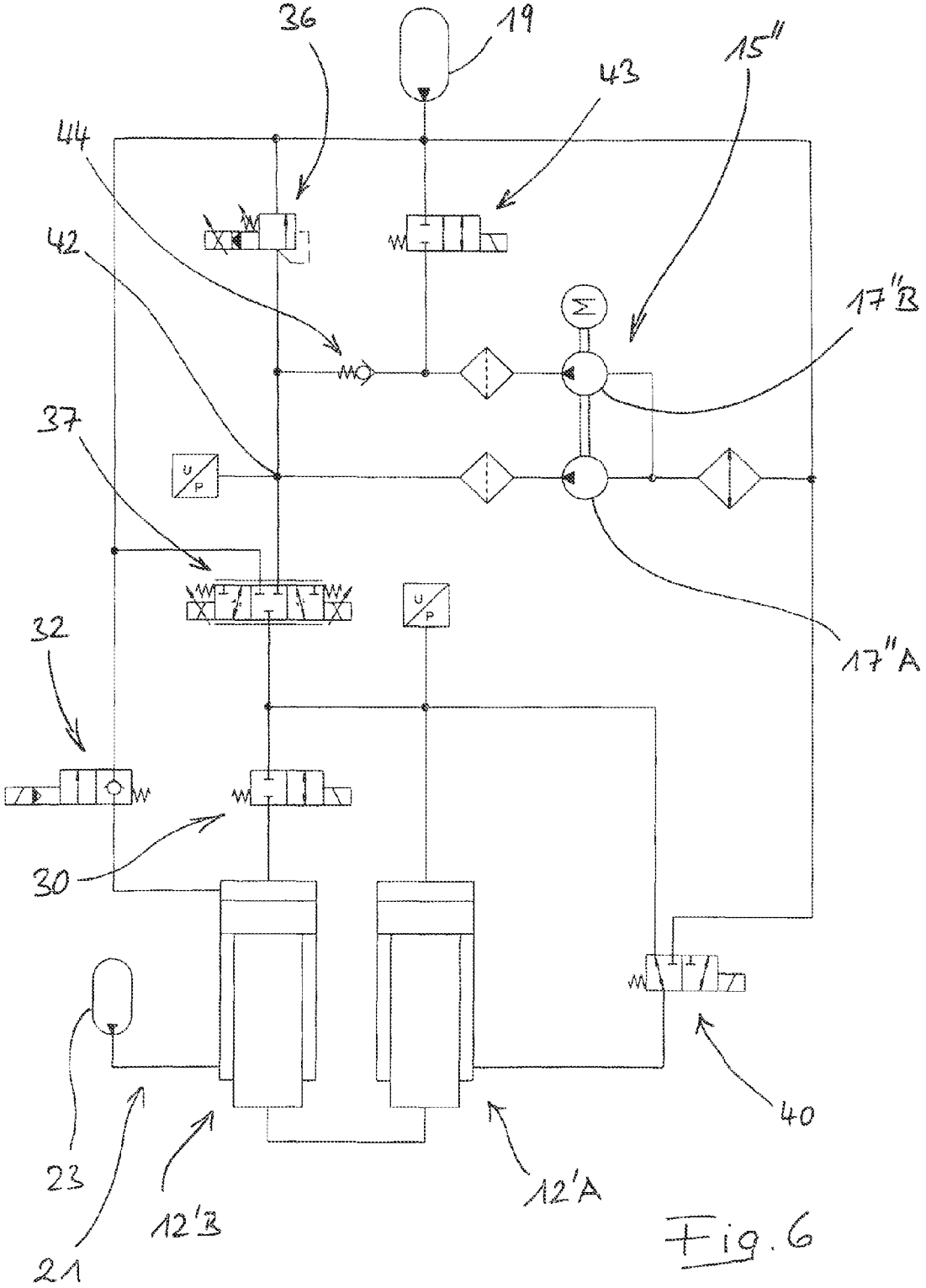

The modified hydraulic system illustrated in FIG. 6 differs from that according to FIG. 5 mainly by a hydraulic assembly 15" with double pump. While the pressure side of the one pump 17"A is constantly in communication with pressure port 42 of directional valve 37, the pressure side of the other pump 17"B can be placed in communication, via valve 43, with pressure accumulator 19, and so pump 17"B can be switched to recirculation delivery. During rapid motion of the hydraulic drive, both pumps 17"A and 17"B—by virtue of a corresponding operating position of valve 43—deliver to hydraulic cylinder-piston unit 12'A. In press motion, however, only pump 17"A—because of changeover of valve 43—delivers to both hydraulic cylinder-piston units 12'A and 12'B, whereas pump 17"B delivers in circulation. Check valve 44 secures the pressure side of pump 17"A against valve 43.

Figure 7:
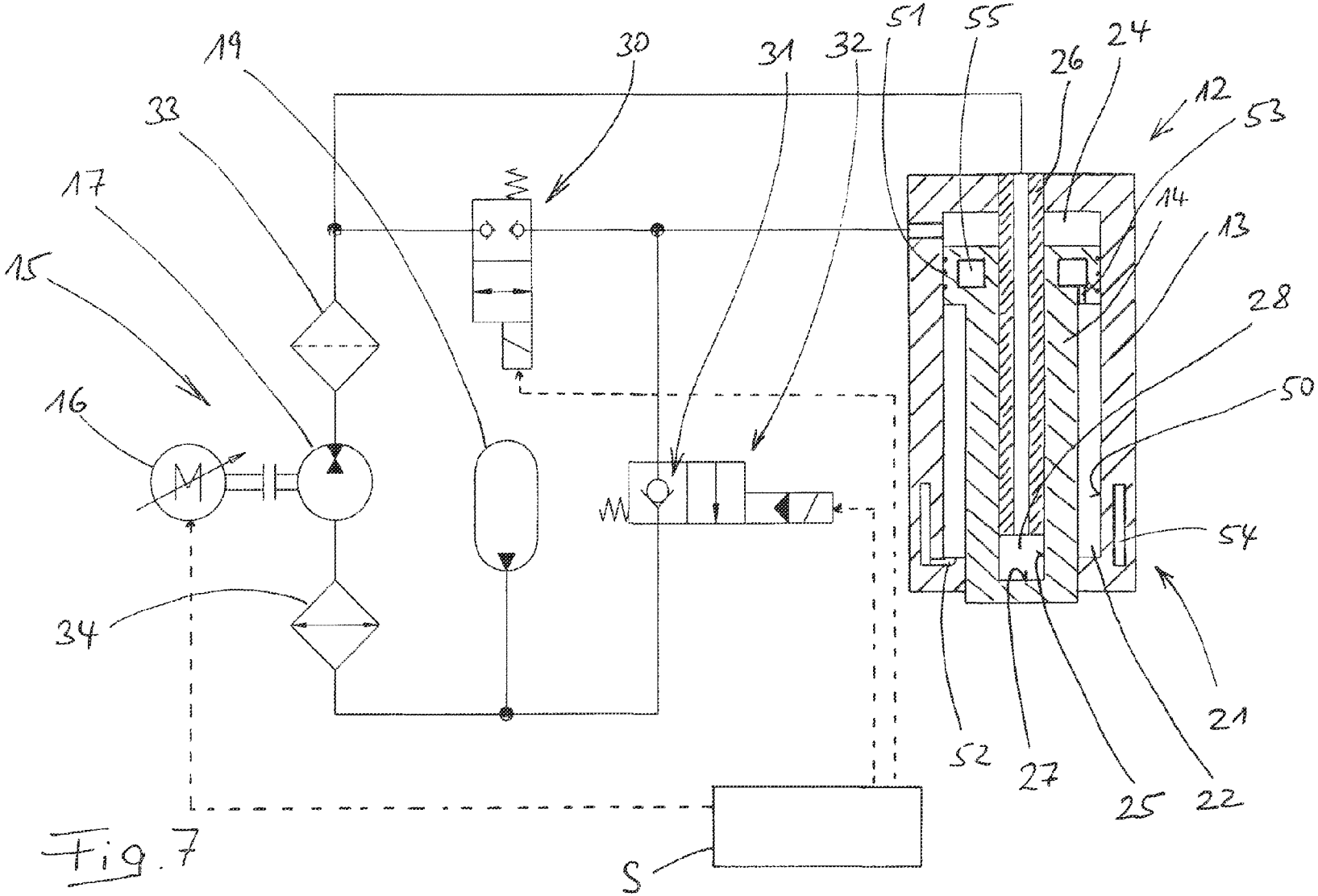
FIG. 7 shows the hydraulic diagram of connections as well as (schematically) the constructive configuration of a cylinder-piston unit of yet another preferred embodiment of the invention.

The hydraulic system according to FIG. 7 corresponds in its main aspects to that according to FIG. 3. For this reason, the explanations and clarifications of FIG. 3 apply analogously to it, with the exception of the differences outlined hereinafter.

In (schematically illustrated) cylinder-piston unit 12, piston-rod working chamber 22 is filled with a spring gas, wherein the gas filling is prepressurized via a corresponding filling pressure. Seals 51 illustrated schematically on piston 14 and bearing sealingly on inside face 50 of cylinder 13 are constructed in a way known in itself as regards the fact that they isolate a gas space from hydraulic working chamber 24 on the piston side. Via corresponding ducts 52 and 53—each of annular construction—equalization chambers, namely a first equalization chamber 54 on the cylinder side and a second equalization chamber 55 on the piston side, are in fluidic communication with piston-rod working chamber 22. Because of the provision of the corresponding equalization chambers for the gas filling of gas-spring unit 21, the axial length of piston-rod working chamber 22 is more or less completely available for the stroke of the piston, meaning that only a small or even no residual volume is needed in piston-rod working chamber 22.

Merely to avoid misunderstandings, it must be emphasized once again at this place that the illustration of cylinder-piston unit 12 according to FIG. 7 is a schematic representation, wherein it is directly obvious in particular that cylinder 13 cannot be constructed in one piece but—in a manner known in itself—is joined together from several parts.

We claim:

1. A machine press (1), especially a folding press, comprising:

a machine structure (3), a lower tool carrier (4) disposed in fixed spatial relationship to the machine structure and an upper tool carrier (7), which can be moved linearly up and down (A) by an operating stroke (H) relative to the lower tool carrier, and with a hydraulic drive (10), which acts on the upper tool carrier and causes the downwardly directed movement of the upper tool carrier, and which is provided with at least one closed, independent hydraulic drive system (8; 9), which in turn comprises at least one hydraulic cylinder-piston unit (12; 12'A, 12'B) and at least one hydraulic assembly (15, 15', 15") pressurizing it and supplied from a storage container;

wherein the at least one hydraulic drive system (8; 9) can be changed over between rapid motion, in which a first effective piston area (27; 45) is pressurized by the at least one hydraulic drive system, and press motion, in which the at least one hydraulic drive system pressurizes a second effective piston area (48; 47) that is substantially larger than the first effective piston area;

wherein the hydraulic fluid of the at least one hydraulic drive system of the hydraulic drive which applies force to cause the downwardly directed movement of the upper tool carrier is stored in a pressure accumulator (19), which constitutes the storage container and constantly imposes at least a base pressure higher than the ambient pressure on the entire hydraulic drive system in question;

wherein no hydraulic communication of any kind exists between a working chamber (22; 22'B) on a piston-rod side and a working chamber (24; 24'B) on a piston side of at least one hydraulic cylinder-piston unit (12; 12'B) of the at least one hydraulic drive system; and wherein the upper tool carrier (7) is forced into its upper end position by means of a spring device (21), which overcompensates the weight of the upper tool carrier, of the tool mounted thereon and of the components of the hydraulic drive associated with the upper tool carrier as well as the closing force implied by the base pressure prevailing in the at least one hydraulic drive system.

2. A machine press according to claim 1, wherein the hydraulic drive (10) comprises two hydraulic drive systems (8, 9) with respectively at least one cylinder-piston unit (12; 12'A, 12'B), wherein each of the two hydraulic drive systems comprises its own hydraulic assembly (15; 15', 15").

3. A machine press according to claim 1, wherein the spring device (21) is integrated into at least one hydraulic cylinder-piston unit (12; 12'B) of the at least one hydraulic drive system (8, 9).

4. A machine press according to claim 3, wherein the spring device (21) is constructed as a gas spring, wherein the piston-rod working chamber (22) has a gas.

5. A machine press according to claim 4, wherein a gas-filled equalization chamber (55) on the piston side and/or a gas-11 lied equalization chamber (54) on a cylinder side is fluidically connected to the piston-rod working chamber (22).

6. A machine press according to claim 3, wherein the spring device (21) is constructed as a gas spring, wherein the piston-rod working chamber (22; 22'B) of the hydraulic cylinder-piston unit (12.; 12'B) is in hydraulic communication with an external pressure accumulator (23).

7. A machine press according to claim 1, wherein an area ratio between the second effective working area (48) and the first effective working area (27) is at least 3.

8. A machine press according claim 1, further comprising a machine controller (S), which is acted on by a pressure sensor (39, 41) that determines the working pressure in the at least one hydraulic drive system (8, 9).

9. A machine press according claim 1, wherein in the at least one hydraulic drive system (8, 9), the at least one hydraulic cylinder-piston unit (12) and the associated hydraulic assembly (15) represent a complete drive (11) with a common control, valve and line block (18), to which the associated pressure accumulator (19) is also directly connected, so that no free pipe or hose lines exist.

10. A machine press according to claim 1, wherein the at least one hydraulic drive system (8, 9) comprises two optionally connectable hydraulic pumps (17"A, 17"B) of different design.

11. A machine press according to claim 1, wherein the at east one hydraulic drive system (8, 9) comprises two optionally connectable hydraulic cylinder-piston units (12'A, 12'B), of which one (12'A) can be operated as a differential cylinder in rapid motion.

12. A machine press according to claim 1, wherein of the at least one hydraulic cylinder-piston unit (12; 2'A, 12'B), a cylinder (13) is disposed in fixed spatial relationship to the machine structure (3) and a piston rod is joined to the upper tool carrier (7).

13. A machine press according to claim 1, wherein the hydraulic assembly is constructed to be reversible.

* * * * *